US007841920B2

(12) United States Patent
Rettberg

(10) Patent No.: US 7,841,920 B2
(45) Date of Patent: Nov. 30, 2010

(54) CRYING TOY DOLLS

(75) Inventor: Tim Rettberg, Seal Beach, CA (US)

(73) Assignee: Mattel, Inc,, El Segundo, CA (US)

( * ) Notice: Subject to any disclaimer, the term of this patent is extended or adjusted under 35 U.S.C. 154(b) by 776 days.

(21) Appl. No.: 11/759,855

(22) Filed: Jun. 7, 2007

(65) Prior Publication Data

US 2008/0026668 A1 Jan. 31, 2008

Related U.S. Application Data

(60) Provisional application No. 60/812,336, filed on Jun. 8, 2006.

(51) Int. Cl.
*A63H 3/24* (2006.01)

(52) U.S. Cl. ..... 446/305; 446/306; 446/391; 446/392; 446/395; 417/471; 417/490

(58) Field of Classification Search ..... 446/304, 446/305, 306, 337, 342, 343, 391, 392, 395, 446/72, 73, 74; 417/471, 557, 445, 490
See application file for complete search history.

(56) References Cited

U.S. PATENT DOCUMENTS

| | | | | |
|---|---|---|---|---|
| 1,268,714 | A | 6/1918 | Hoefler | |
| 1,926,574 | A | 9/1933 | Zaiden | |
| 2,111,507 | A | 3/1938 | Hogan | |
| 2,157,763 | A | 5/1939 | Konikoff et al. | |
| 2,196,912 | A | 4/1940 | Gilbraith | |
| RE21,539 | E | 8/1940 | Wittman | |
| 2,566,487 | A * | 9/1951 | Gora et al. | 222/79 |
| 2,572,795 | A | 10/1951 | Wood et al. | |
| 2,688,208 | A | 10/1951 | Bannister | |
| 2,675,644 | A | 4/1954 | Senior et al. | |
| 2,689,430 | A | 9/1954 | Freeland | |
| 2,689,432 | A | 9/1954 | Beebe | |
| 2,748,530 | A | 6/1956 | Stecker | |
| 2,811,810 | A | 11/1957 | Ostrander | |
| 2,812,615 | A | 11/1957 | Zanca et al. | |
| 2,818,678 | A | 1/1958 | Lemelson | |
| 2,819,560 | A | 1/1958 | Cohn | |
| 2,827,734 | A | 3/1958 | Beebe | |
| 2,888,777 | A | 6/1959 | Kaplan | |
| 2,907,139 | A | 10/1959 | Rekettye | |
| 2,934,856 | A | 5/1960 | Cohn | |
| 2,934,857 | A | 5/1960 | Birnbaum | |

(Continued)

FOREIGN PATENT DOCUMENTS

| | | |
|---|---|---|
| EP | 104007 | 3/1984 |

(Continued)

*Primary Examiner*—Gene Kim
*Assistant Examiner*—Matthew B Stanczak
(74) *Attorney, Agent, or Firm*—Kolisch Hartwell, P.C.

(57) ABSTRACT

Toy dolls including a body and a fluid-transport mechanism supported by the body and configured to receive a liquid from a liquid delivery device and dispense the liquid from the toy doll. In some embodiments, the fluid-transport mechanism includes a reservoir for collecting the liquid, a plunger disposed within the reservoir, and an activation mechanism configured to move the plunger from a fluid-delivery position to a fluid-receipt position when the liquid delivery device is inserted into the input region.

20 Claims, 3 Drawing Sheets

U.S. PATENT DOCUMENTS

| | | | | | |
|---|---|---|---|---|---|
| 2,954,639 | A | | 10/1960 | Walss | |
| 2,954,640 | A | | 10/1960 | Catalano et al. | |
| 2,959,890 | A | | 11/1960 | Ostrander | |
| 2,978,833 | A | | 4/1961 | Tancredi | |
| 3,016,651 | A | | 1/1962 | Brudney | |
| 3,053,009 | A | | 9/1962 | Ostrander | |
| 3,091,891 | A | | 6/1963 | Brudney | |
| 3,193,968 | A | | 7/1965 | Brudney | |
| 3,412,504 | A | | 11/1968 | Crosman | |
| 3,444,645 | A | | 5/1969 | Tepper et al. | |
| 3,445,955 | A | | 5/1969 | Ryan et al. | |
| 3,477,169 | A | * | 11/1969 | Gardel et al. | 446/301 |
| 3,514,899 | A | * | 6/1970 | Boydman et al. | 446/298 |
| 3,548,594 | A | * | 12/1970 | Ceppi | 60/539 |
| 3,641,703 | A | * | 2/1972 | Tepper et al. | 446/295 |
| 3,699,707 | A | | 10/1972 | Sapkus | |
| 3,745,696 | A | | 7/1973 | Sapkus et al. | |
| 3,758,983 | A | | 9/1973 | Cagen | |
| 3,769,745 | A | | 11/1973 | Crosman | |
| 3,789,539 | A | | 2/1974 | Cagen | |
| 3,841,020 | A | | 10/1974 | Ryan et al. | |
| 3,855,729 | A | | 12/1974 | Sapkus et al. | |
| 3,959,919 | A | | 6/1976 | Baulard-Cogan | |
| 4,050,185 | A | | 9/1977 | Terzian | |
| 4,074,460 | A | | 2/1978 | Thorn et al. | |
| 4,151,675 | A | | 5/1979 | Juan | |
| 4,160,338 | A | | 7/1979 | Lyons et al. | |
| 4,339,889 | A | | 7/1982 | Guerrero et al. | |
| 4,356,663 | A | | 11/1982 | Terzian | |
| 4,439,162 | A | | 3/1984 | Blaine | |
| 4,443,200 | A | | 4/1984 | Murphy | |
| 4,850,930 | A | | 7/1989 | Sato et al. | |
| 4,900,287 | A | | 2/1990 | Fusi et al. | |
| 5,002,514 | A | | 3/1991 | Takei | |
| 5,083,962 | A | | 1/1992 | Pracas | |
| 5,083,965 | A | | 1/1992 | Mayem | |
| 5,094,644 | A | | 3/1992 | Kelley | |
| 5,190,492 | A | | 3/1993 | Berenguer | |
| 5,254,028 | A | | 10/1993 | Liao | |
| 5,509,808 | A | | 4/1996 | Bell | |
| 5,941,750 | A | | 8/1999 | Pracas | |
| 6,033,229 | A | | 3/2000 | Scherman et al. | |
| 6,234,862 | B1 | | 5/2001 | Wittenberg | |
| 6,767,271 | B2 | | 7/2004 | Tsui | |
| 6,793,551 | B1 | * | 9/2004 | Rehkemper et al. | 446/130 |
| 2001/0029146 | A1 | | 10/2001 | Llorens | |
| 2005/0255788 | A1 | | 11/2005 | Ellman et al. | |

FOREIGN PATENT DOCUMENTS

| | | |
|---|---|---|
| EP | 274449 | 7/1988 |
| FR | 2537450 | 6/1984 |
| GB | 0761894 | 11/1956 |
| GB | 0965188 | 7/1964 |
| GB | 1142372 | 2/1969 |
| GB | 1176168 | 1/1970 |
| GB | 1199160 | 7/1970 |
| GB | 2011264 | 7/1979 |
| GB | 2198363 | 6/1988 |
| GB | 2230200 | 10/1990 |
| GB | 2279885 | 1/1995 |
| JP | 01131693 | 5/1989 |
| JP | 10137453 | 5/1998 |
| JP | 2000262760 | 9/2000 |
| WO | 8901812 | 3/1989 |
| WO | 2005000439 | 1/2005 |
| WO | 2005072840 | 8/2005 |
| WO | 2005115577 | 12/2005 |

* cited by examiner

CRYING TOY DOLLS

RELATED APPLICATION

This application is based upon and claims priority under 35 U.S.C. §119(e) to U.S. Provisional Application Ser. No. 60/812,336, entitled "DOLL WITH TEAR DUCTS," filed on Jun. 8, 2006, the content of which is incorporated herein by reference in its entirety for all purposes.

BACKGROUND

The present disclosure relates to toy dolls, and more particularly to toy dolls that are adapted to discharge a liquid in response to a predetermined user manipulation of the toy dolls.

Examples of toy dolls adapted to discharge a liquid are disclosed in the following patent documents, the entire disclosures of which are incorporated herein by reference in their entireties for all purposes: U.S. Pat. Nos. 2,689,432, 2,907,139, 3,412,504, 3,444,645, 3,445,955, 3,745,696, 3,758,983, 3,769,745, 3,789,539, 3,841,020, 3,959,919, 4,050,185, 4,151,675, 4,160,338 4,339,889, 4,356,663, 4,443,200, 4,900,287, 5,002,514, 5,083,962, 5,083,965, 5,094,644, 5,254,028, 5,509,808, 5,941,750, 6,033,229, 6,234,862, US20050255788, PCT/US05/016886, GB0761894, GB1142372, GB1176168, and GB1199160.

SUMMARY

Toy dolls according to the present disclosure include a body and a fluid-transport mechanism supported by the body that is configured to receive a liquid from a liquid delivery device and dispense the liquid from the toy doll. The fluid-transport mechanism may include a reservoir for collecting the liquid, a plunger disposed within the reservoir, and an activation mechanism configured to move the plunger from a fluid-delivery position to a fluid-receipt position when the liquid delivery device is inserted into the input region.

In some embodiments, the activation mechanism includes an activation lever configured to pivot about an axis. The activation lever may include a first portion configured to be engaged by the liquid delivery device in the input region and a second portion operatively coupled to the plunger. In some embodiments, when the activation lever pivots in a first direction, the plunger moves away from the outlet of the reservoir, and when the activation lever pivots in a second direction opposite the first direction, the plunger moves toward the outlet of the reservoir.

DETAILED DESCRIPTION

Figure 1:
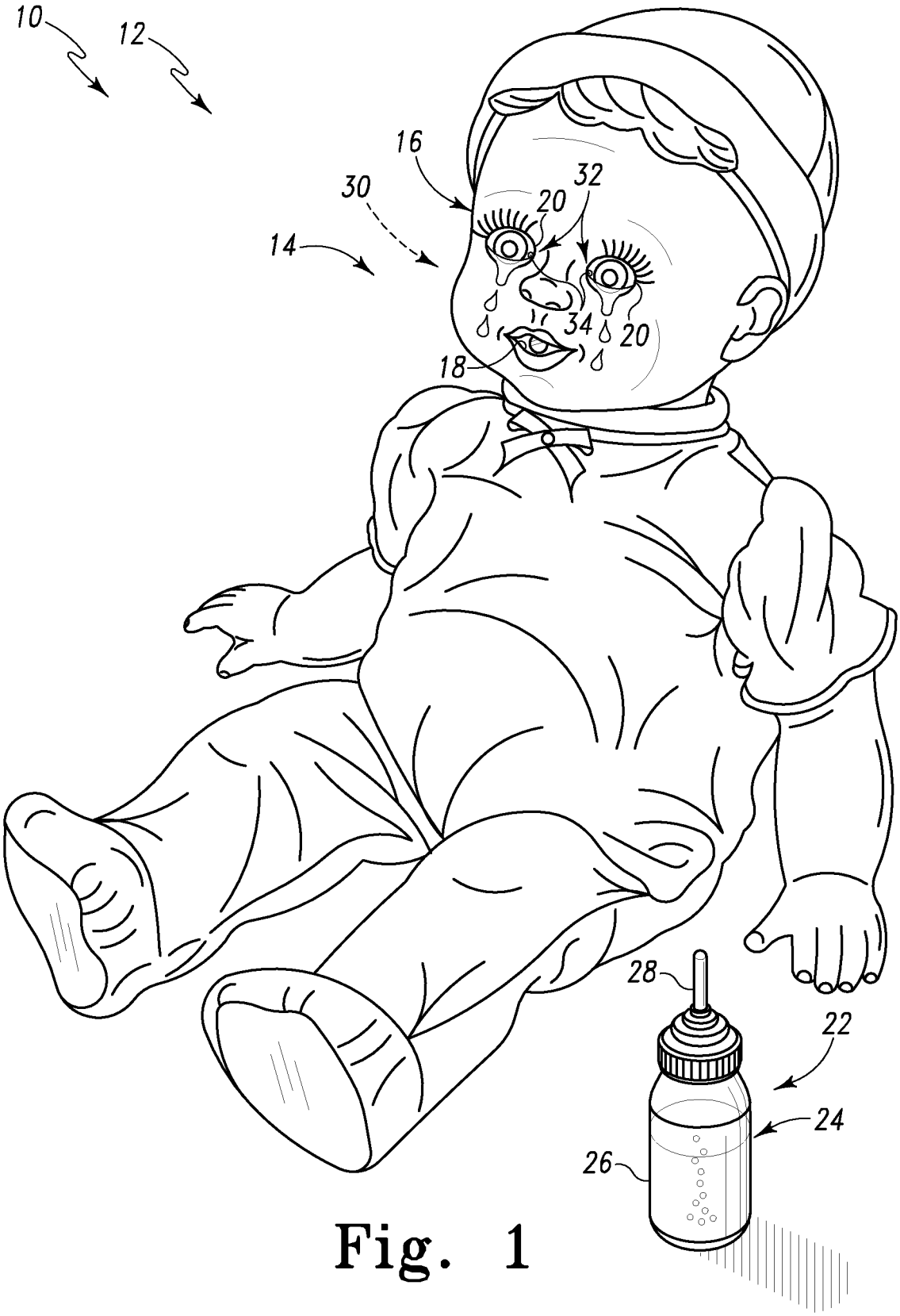
FIG. 1 is an isometric view of a toy doll according to the present disclosure and including a liquid delivery device in the form of a toy baby bottle.

A non-exclusive example of a toy doll 10 according to the present disclosure is illustrated in FIG. 1 and is generally indicated at 12. As shown, dolls 12 may include a body 14 with a head 16 having a mouth opening 18 and eyes 20; however, dolls according to the present disclosure are not limited to human and/or standard configurations.

Dolls 10 may be accompanied by a liquid delivery device 22. In FIG. 1, device 22 is in the form of a toy baby bottle 24 having a squeezable bottle portion 26 and a nipple 28 adapted to dispense liquid from the bottle portion when it is squeezed by a user; however, other liquid delivery devices are equally within the scope of the present disclosure.

Dolls 10 include a fluid-transport mechanism 30 supported by body 14 and configured to receive liquid from a liquid delivery device and subsequently discharge the liquid from the doll. For example, in the illustrated doll 12, the fluid-transport mechanism 30 is configured to receive liquid (e.g., water) from the toy baby bottle 24 via the doll's mouth opening 18, and to deliver the liquid to a pair of discharge ports 32 in the form of tear ducts 34 positioned adjacent the doll's eyes. In use, a user inserts the toy baby bottle through the doll's mouth opening and squeezes the bottle portion to dispense liquid therefrom. When the user removes the toy baby bottle from the doll's mouth opening, at least a portion of the liquid received from the toy baby bottle is discharged through tear ducts 34, thereby giving the appearance of crying.

Though illustrated as a crying doll, other examples of dolls 10 are equally within the scope of the present disclosure. That is, dolls 10 may include fluid-transport mechanisms 30 that receive liquid from structure other than a mouth opening and/or may discharge liquid from structure other than tear ducts. For example, dolls 10 may be configured to receive liquid via a mouth opening, yet configured to discharge at least a portion of the received liquid via a discharge port positioned in the doll's body so as to simulate a wetting, or peeing, doll. Other configurations are equally within the scope of the present disclosure.

Figure 2:
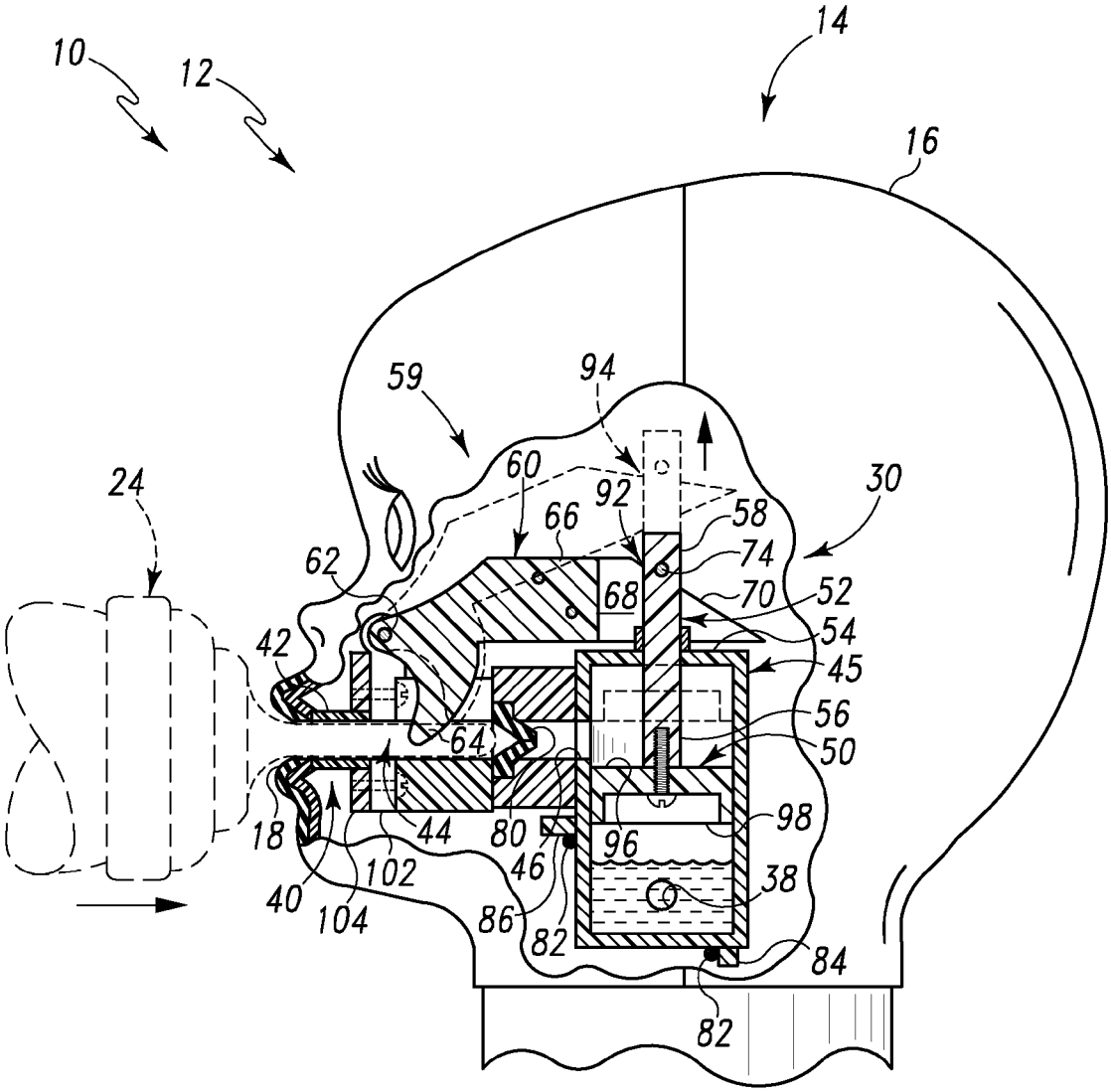
FIG. 2 is a cut-away cross-sectional view of the head of the toy doll of FIG. 1, illustrating a fluid-transport mechanism for receiving liquid via the doll's mouth and dispensing liquid via a discharge port adjacent the doll's eyes.

As shown in FIG. 2, doll 12 may include an input region 40 positioned behind the mouth opening and configured to receive the liquid delivery device. The input region may include a generally cylindrical tube 42 and have an open portion 44 on the top of the input region (as viewed when doll 12 is in an upright orientation).

Fluid-transport mechanism 30 may include a reservoir 45 for collecting liquid received from the liquid delivery device via input region 40. The reservoir therefore may include an inlet 46 fluidly connecting the reservoir to the input region. Reservoir 45 may also include one or more outlets 38 (two in the illustrated example) for delivering the received liquid to the tear ducts 34 via one or more conduits 48 (two in the illustrated example). The reservoir may be sized to hold substantially the same volume of liquid as an associated liquid delivery device. A plunger 50 may be disposed within the reservoir and be configured to force received liquid in the reservoir out through the outlets. A connecting rod 52 may be coupled to the plunger and extend from an open end 54 of the reservoir. The connecting rod includes a first end region 56 coupled to the plunger and a second end region 58 opposite the first end region.

Fluid-transport mechanism 30 includes an activation mechanism 59 that is configured to move the plunger from a fluid-delivery position to a fluid-receipt position when the liquid delivery is inserted into the input region, and further configured to move the plunger from the fluid-receipt position to the fluid-delivery position when the liquid delivery device is removed from the input region. In FIG. 2, the plunger is illustrated in the fluid-delivery position in solid lines and in the fluid-receipt position in dashed lines.

In some embodiments of dolls 10, including the illustrated doll 12, fluid-transport mechanism 30 may include an activation lever 60 configured to pivot about an axis 62. Lever 60 may include a first portion 64 generally extending from axis 62 in a first direction. At least a portion of first portion 64 is disposed in the input region when the fluid-transport mechanism is in a first, or default, configuration. As shown in FIG. 2 in solid lines, when the fluid-transport mechanism is in the first configuration, the lever extends into the input region through the open portion 44 thereof. Lever 60 may also include a second portion 66 generally extending from axis 62 in a second direction.

Second portion 66 may include one or more arms 68 extending generally over the reservoir (as viewed with the doll in an upright orientation) and adjacent the connecting rod. Arms 68 each may include a generally planar cam surface 70. A follower 72, in the form of a rod 74 may be coupled to the second end region of the connecting rod and be in sliding surface contact with the cam surfaces 70 of arms 68.

Fluid-transport mechanism 30 may further include a one-way valve 80 disposed at least partially in the input region and configured to permit liquid to be delivered from the liquid delivery device to the reservoir, while generally preventing liquid from migrating from the reservoir back through the one-way valve. In some embodiments, the one-way valve may be positioned and configured so that at least a portion of the liquid delivery device passes through the valve when the device is inserted into the input region. In other words, the valve may be configured so that the nipple 28 of the liquid delivery device passes through and opens the valve to permit liquid to be delivered to the reservoir.

In other embodiments, the valve may be positioned and configured so that when the liquid delivery device is inserted into the input region and a flow of liquid is expelled from the liquid delivery device, the flow of liquid forces open and passes through the one-way valve. In other words, the valve may be configured so that a sufficient pressure of liquid on the upstream side of the valve (i.e., the side toward the mouth opening of the doll) will open the valve and permit the liquid to pass therethrough.

In some embodiments, valve 80 may be described as a duckbill valve.

Figure 3:
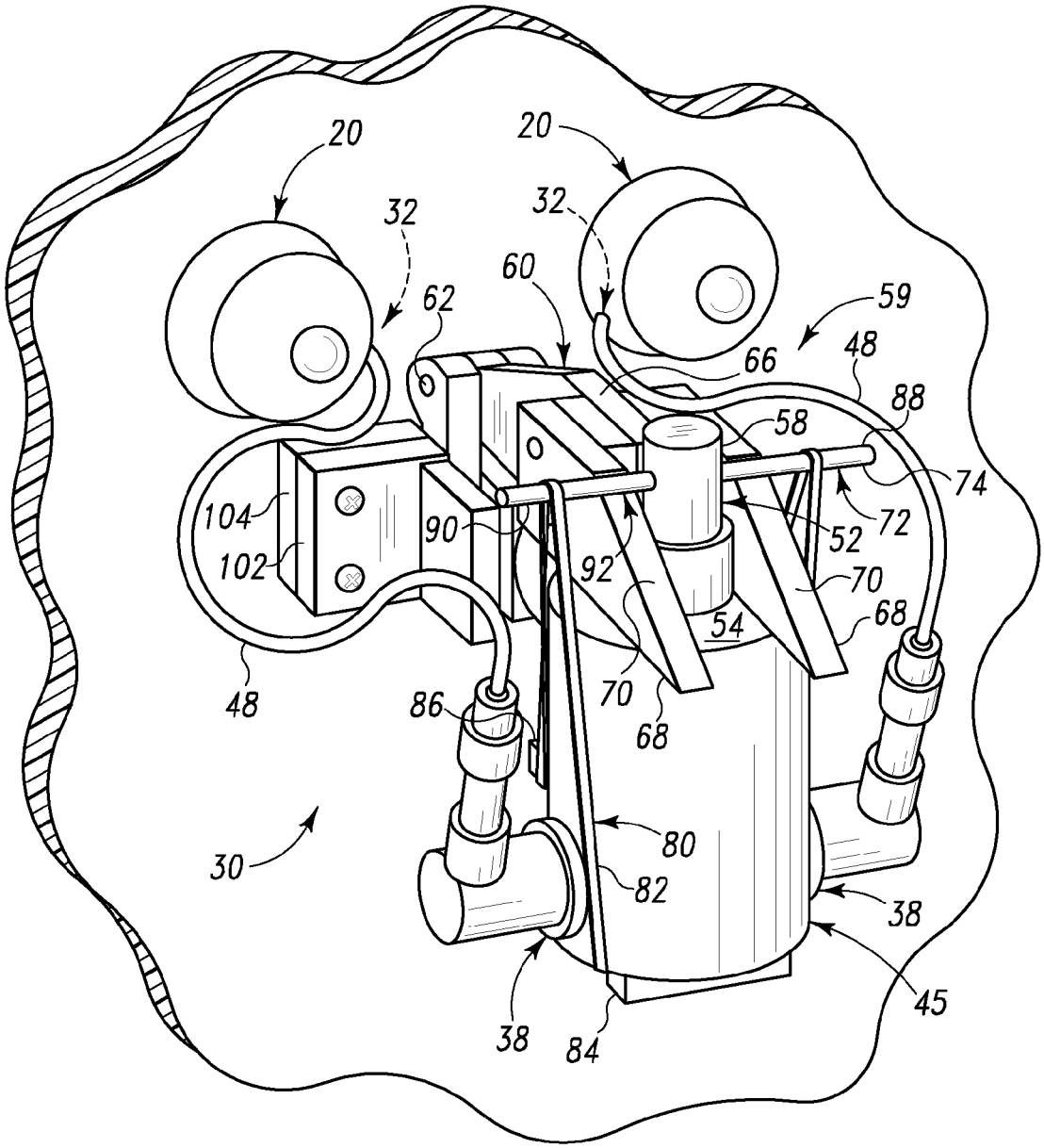
FIG. 3 is an isometric view of the fluid-transport mechanism illustrated in FIG. 2.

Fluid-transport mechanism 30 of doll 12 also includes a biasing member 80 in the form of a rubber band 82 that biases the plunger toward the outlets of the reservoir. As best seen in FIG. 3, the rubber band is secured behind a pair of ledges 84, 86 integral to the reservoir structure, and looped over end regions 88, 90 of follower rod 74. Biasing members other than rubber bands (e.g., springs) are equally within the scope of the present disclosure.

Fluid-transport mechanism 30 may be described as having a first configuration when a liquid delivery device, or other object, is not positioned within the input region of the doll, as generally indicated in solid lines in FIG. 2. Fluid-transport mechanism 30 may be reconfigured to a second configuration (generally indicated in dashed lines in FIG. 2) by inserting a liquid delivery device, or other object, through the mouth opening so that the device engages the first portion 64 of the activation lever and causes it to pivot about axis 62 in a first direction against the biasing force of the rubber band. When the fluid-transport mechanism is in the second configuration, the first portion of the activation lever is at least less disposed within the input region than when the fluid-transport mechanism is in the first configuration. As the fluid-transport mechanism is being reconfigured from the first configuration to the second configuration, the activation lever forces the plunger to move away from the outlets and toward the fluid receipt position, and thereby permit the reservoir to receive liquid from the liquid delivery device. Conversely, removing the liquid delivery device from the input region permits the activation lever to pivot about the axis in a second direction opposite the first direction and thereby cause the plunger to move toward the outlet and toward the fluid delivery position due to the biasing force of the rubber band and thereby force at least a portion of any liquid within the reservoir through the outlets, through the conduits, and out the tear ducts.

When the fluid-transport mechanism is in the first configuration, follower 72 is in surface contact with the cam surfaces 70 at first positions 92, and when the fluid-transport mechanism is in the second configuration, follower 72 is in surface contact with the cam surfaces 72 at a second position 94. In some embodiments, the cam surface is shaped so that the connecting rod translates generally linearly relative to the reservoir when the fluid-transport mechanism reconfigures between the first and second configurations. Stated differently, the cam surface may be shaped so that when the activation lever pivots a predetermined range, the connecting rod translates generally linearly relative to the reservoir.

In doll 12, when the fluid-transport mechanism is in the first configuration (and the plunger in the fluid-delivery position), the plunger is positioned such that the reservoir inlet 46 is on a first side 96 of the plunger and the reservoir outlets 38 are on a second side 98 of the plunger, the second side opposite the first side. Conversely, when the fluid-transport mechanism is in the second configuration (and the plunger is in the fluid-receipt position), the plunger is positioned such that both the inlet and the outlets are on the second side of the plunger.

As best seen in FIG. 2, fluid-transport mechanism 30 may be coupled to the doll's head at or generally near the doll's mouth. For example, fluid-transport mechanism 30 may include a first mounting plate 102 configured to be attached to a second mounting plate 104 secured to the inside surface of the head and generally surrounding the inside of the mouth opening. In the illustrated example, first mounting plate 104 also provides the axis 62 about which activation lever 60 pivots. Other configurations are equally within the scope of the present disclosure.

Additional features may be incorporated into toy dolls according to the present disclosure. For example, a doll may include a sound generator configured to emit predetermined sounds in response to an object being inserted into, or removed from, the mouth of the doll. A toy doll may also include a mechanism configured to close the doll's eyes when an object is inserted into the doll's mouth. Additionally or alternatively, the doll's eyes may be configured to automatically close in response to the doll being reoriented from an upright orientation to a laid-back orientation. Examples of dolls incorporating these and other features are disclosed in U.S. patent application Ser. No. 11/759,795, entitled "DOLLS WITH ALTERABLE FACIAL FEATURES," filed on Jun. 8, 2007, the entire contents of which are incorporated herein by reference for all purposes.

The disclosure set forth above encompasses multiple distinct inventions with independent utility. While each of these inventions has been disclosed in a preferred form or method, the specific alternatives, embodiments, and/or methods thereof as disclosed and illustrated herein are not to be considered in a limiting sense, as numerous variations are possible. The present disclosure includes all novel and non-obvious combinations and subcombinations of the various elements, features, functions, properties, methods and/or steps disclosed herein. Similarly, where any disclosure above or claim below recites "a" or "a first" element, step of a method, or the equivalent thereof, such disclosure or claim should be understood to include one or more such elements or steps, neither requiring nor excluding two or more such elements or steps.

Inventions embodied in various combinations and subcombinations of features, functions, elements, properties, steps and/or methods may be claimed through presentation of new claims in a related application. Such new claims, whether they are directed to a different invention or directed to the same invention, whether different, broader, narrower, or equal in scope to the original claims, are also regarded as included within the subject matter of the present disclosure.

The invention claimed is:

1. A toy doll comprising:

an input region configured to receive a liquid delivery device;

a discharge port; and a fluid-transport mechanism configured to receive a liquid from the liquid delivery device and deliver the liquid to the discharge port, the mechanism including:

a reservoir for collecting the liquid, the reservoir including an inlet fluidly connected to the input region, and an outlet in fluid communication with the discharge port;

a plunger disposed within the reservoir and movable between a fluid-receipt position and a fluid-delivery position; and an activation mechanism configured to move the plunger from the fluid-delivery position to the fluid-receipt position when the liquid delivery device is inserted into the input region, and further configured to move the plunger from the fluid-receipt position to the fluid-delivery position when the liquid delivery device is removed from the input region;

wherein the fluid-transport mechanism is in a first configuration when the plunger is in the fluid-delivery position, and the fluid-transport mechanism is in a second configuration when the plunger is in the fluid-receipt position;

wherein the activation mechanism includes an activation lever configured to pivot about an axis, the activation lever including a first portion and a second portion, wherein at least a portion of the first portion is disposed in the input region when the activation mechanism is in a first configuration and the first portion is less disposed in the input region when the activation mechanism is in a second configuration, and wherein the second portion is operatively coupled to the plunger;

wherein insertion of the liquid delivery device into the input region so that the liquid delivery device engages the first portion of the activation lever causes the activation lever to pivot about the axis in a first direction, move the plunger away from the outlet, and permit the reservoir to receive liquid from the liquid delivery device through the inlet;

wherein removal of the liquid delivery device from the input region causes the activation lever to pivot about the axis in a second direction opposite the first direction, to move the plunger toward the outlet and force at least a portion of received liquid through the outlet, and out the discharge port; and wherein the fluid-transport mechanism further includes:

a connecting rod having a first end region coupled to the plunger and a second end region opposite the first end region; and a follower coupled to the second end region of the connecting rod and in surface contact with the second portion of the activation lever.

2. The toy doll of claim 1, wherein the second portion of the activation lever includes a cam surface; and wherein the follower is in sliding contact with the cam surface so that the follower is in surface contact with the cam surface at a first position when the fluid-transport mechanism is in the first configuration, and the follower is in surface contact with the cam surface at a second position when the fluid-transport mechanism is in the second configuration.

3. The toy doll of claim 2, wherein the cam surface is shaped so that the connecting rod translates generally linearly relative to the reservoir when the fluid-transport mechanism reconfigures between the first and second configurations.

4. The toy doll of claim 2, wherein the cam surface is generally planar.

5. The toy doll of claim 1, wherein the toy doll further includes a head with a mouth opening, and the input region is positioned behind the mouth opening.

6. The toy doll of claim 1, wherein the toy doll further includes an eye, and the discharge port is located adjacent the eye.

7. The toy doll of claim 1, wherein the plunger is biased toward the fluid-delivery position.

8. The toy doll of claim 7, wherein the fluid-transport mechanism further includes a rubber band that biases the plunger toward the outlet of the reservoir.

9. The toy doll of claim 1, further comprising a one-way valve disposed at least partially in the input region and configured to permit liquid to be delivered from the liquid delivery device to the reservoir.

10. The toy doll of claim 9, wherein the one-way valve is positioned so that at least a portion of the liquid delivery device passes through the one-way valve when the liquid delivery device is inserted into the input region and the fluid-transport mechanism is reconfigured from the first configuration to the second configuration.

11. The toy doll of claim 9, wherein the one-way valve is positioned and configured so when the liquid delivery device is inserted into the input region and a flow of liquid is expelled from the liquid delivery device, the flow of liquid forces open and passes through the one-way valve.

12. The toy doll of claim 1, wherein when the fluid-transport mechanism is in the first configuration the inlet to the reservoir is on a first side of the plunger and the outlet to the reservoir is on a second side of the plunger, the second side opposite the first side.

13. The toy doll of claim 12, wherein when the fluid-transport mechanism is in the second configuration the inlet and the outlet to the reservoir are both on the second side of the plunger.

14. A toy doll comprising:

a mouth opening;

an input region positioned behind the mouth opening and configured to receive a liquid delivery device;

an eye;

a discharge port positioned adjacent the eye; and a fluid-transport mechanism configured to receive a liquid from the liquid delivery device and deliver it to the discharge port, the fluid-transport mechanism including:

a reservoir for collecting the liquid, the reservoir including an inlet fluidly connected to the input region, and an outlet in fluid communication with the discharge port;

a plunger disposed within the reservoir;

a connecting rod having a first end coupled to the plunger and a second end, the connecting rod extending from the reservoir;

a follower coupled to the second end of the connecting rod;

an activation lever configured to pivot about an axis and including:

a first portion; wherein at least a portion of the first portion is disposed in the input region when the fluid-transport mechanism is in a first configuration and the first portion is less disposed in the input region when the fluid-transport mechanism is in a second configuration;

and a second portion including a cam surface in sliding contact with the follower; and a biasing member that biases the fluid-transport mechanism toward the first configuration;

wherein insertion of the liquid delivery device into the input region so that the liquid delivery device engages the first portion of the activation lever causes the activation lever to pivot about the axis in a first direction, move the plunger away from the outlet, and permit the reservoir to receive liquid from the liquid delivery device; and wherein removal of the liquid delivery device from the input region causes the activation lever to pivot about the axis in a second direction opposite the first direction, to move the plunger toward the outlet and force at least a portion of received liquid through the outlet, and out the discharge port.

15. A toy doll comprising:

a body; and a fluid-transport mechanism supported by the body and configured to receive a liquid from a liquid delivery device and dispense the liquid from the toy doll, the fluid-transport mechanism including:

a reservoir for collecting the liquid, the reservoir including an inlet and an outlet;

a plunger disposed within the reservoir;

a connecting rod coupled to the plunger and extending from the reservoir; and an activation lever configured to pivot about an axis and including a first portion configured to be engaged by the liquid delivery device and a second portion coupled to the connecting rod;

wherein when the activation lever pivots in a first direction, the plunger moves away from the outlet of the reservoir, and when the activation lever pivots in a second direction opposite the first direction, the plunger moves toward the outlet of the reservoir;

wherein the second portion of the activation lever includes a cam surface; and wherein the fluid-transport mechanism further includes a follower that couples the connecting rod to the second portion of the activation lever and is in sliding contact with the cam surface.

16. The toy doll of claim 15, wherein the body includes a head having a mouth and an eye;

wherein the fluid-transport mechanism is configured to receive liquid from the liquid delivery device via the mouth and dispense the liquid adjacent the eye.

17. The toy doll of claim 15, wherein the plunger is biased toward the outlet of the reservoir.

18. The toy doll of claim 15, wherein the cam surface is shaped so that when the activation lever pivots a predetermined range, the connecting rod translates generally linearly relative to the reservoir.

19. The toy doll of claim 15, wherein the plunger is movable between a fluid-receipt position and a fluid-delivery position, and is biased toward the fluid-delivery position.

20. The toy doll of claim 19, wherein the fluid-transport mechanism further includes a rubber band that biases the plunger toward the outlet of the reservoir.

* * * * *